United States Patent [19]

Hiraguri

[11] 4,370,524

[45] Jan. 25, 1983

[54] CIRCUIT FOR TIME COMPRESSION AND EXPANSION OF AUDIO SIGNALS

[75] Inventor: Seisuke Hiraguri, Yokohama, Japan

[73] Assignee: Victor Company of Japan, Ltd., Yokohama, Japan

[21] Appl. No.: 195,639

[22] Filed: Oct. 9, 1980

Related U.S. Application Data

[63] Continuation-in-part of Ser. No. 962,794, Nov. 20, 1978, abandoned.

[30] Foreign Application Priority Data

Nov. 22, 1977 [JP] Japan ..... 52-139439

[51] Int. Cl.[3] ..... G10L 1/00

[52] U.S. Cl. ..... 179/15.55 T

[58] Field of Search ..... 179/15.55 T, 15.55 R, 179/1.5 H; 360/8; 358/134, 127; 364/410, 513

[56] References Cited

U.S. PATENT DOCUMENTS 3,949,175 4/1976 Tanizoe ..... 179/15.55 T 4,141,039 2/1979 Yamamoto ..... 179/15.55 T

FOREIGN PATENT DOCUMENTS 1407196 9/1975 United Kingdom ..... 179/15.55 T

*Primary Examiner*—Emanuel S. Kemeny

*Attorney, Agent, or Firm*—Michael N. Meller; Anthony H. Handal

[57] ABSTRACT

A time compression or expansion circuit for audio signals comprises an analog to digital converter (12), a random access memory (17), a latch circuit (18), a digital to analog converter (19), a clock pulse generator (13), a counter circuit (14), a data selector (16), and a timing controller (13). The timing controller (15) is supplied with a clock pulse from the clock pulse generator (13) and a timing signal from the counter circuit (18), and produces a series of writing-in pulses and a series of strobe pulses which exist alternately and have a common frequency regardless of the mode of compression or expansion or rate thereof. The analog to digital converter (12) converts an input audio signal (11) to a digital signal in response to a writing-in and reading-out switching pulse from the counter circuit (18). The random access memory (17) writes the signal from the analog to digital converter (12) in response to the writing-in pulse fed from the timing controller (15), into an address thereof designated by an address datum for writing-in, and reading a signal out of an address thereof designated by an address datum for reading-out in response to the strobe pulse of the common frequency in such a way that the written address of the memory is read multiple times or skipped being read according to the mode and rate. The latch circuit (18) holds the signal read out from the random access memory (17) in response to the strobe pulse from the timing controller (15).

7 Claims, 6 Drawing Figures

CIRCUIT FOR TIME COMPRESSION AND EXPANSION OF AUDIO SIGNALS

BACKGROUND OF THE INVENTION

This is a continuation-in part of the parent application Ser. No. 962,794, filed Nov. 20, 1978, now abandoned.

The present invention relates generally to time compression and expansion circuits of audio signals, and more particularly to a time compression and expansion circuit of audio signals wherein, in restoring a frequency spectrum of a signal reproduced from a recording and reproducing apparatus to the original at a speed different from that in recording, the reproduced signal is subjected to time compression or expansion, in a simplified circuit organization.

Heretofore, there has been a time compression or expansion circuit including an analog to digital (A/D) converter, a random access memory (RAM) and a digital to analog (D/A) converter.

In a case of carrying out, for instance, double time expansion by this circuit, a reproduced audio signal is converted to a digital signal in the A/D converter, and the digital signal thus converted is then written in the RAM and simultaneously read out at a speed of twice writing-in speed. The signal thus read out is converted to an analog signal, thus obtaining a signal expanded two times in time base.

This known circuit uses a reading-out pulse having a pulse period which is one half of that of a writing-in pulse, for carrying out reading-out operation from the RAM. Therefore, in order to form the above described pulses having different periods, separate clock pulse generators and frequency dividers and the like are required. Accordingly, a difficulty that a circuit organization is rather complicated is accompanied.

SUMMARY OF THE INVENTION

Accordingly, it is a general object of the present invention to provide a novel and useful time compression and expansion circuit of audio signals in which the above described difficulty has been overcome.

Another and specific object of the present invention is to provide a circuit in which signal writing in and reading out from the memory is carried out through the use of pulses having the same period, and designation of address for writing and reading is made at mutually different speeds, thus accomplishing time compression or expanison of audio signal. According to the present invention, a circuit organization is simplified, and moreover, becomes appropriate to achieve a large scale integration circuit, in particular.

Other objects and further features of the present invention will be apparent from the following detailed description with respect to preferred embodiments when read in conjunction with the accompanying drawings.

DETAILED DESCRIPTION OF THE INVENTION

Figure 1:
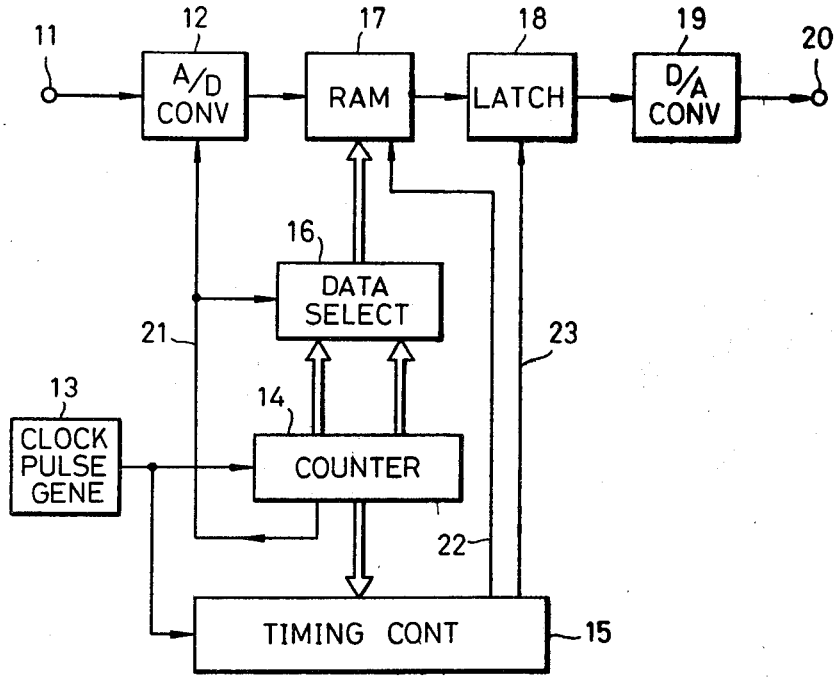
FIG. 1 is a block diagram showing one embodiment of a circuit for time compression and expansion of audio signals, according to the present invention.

One embodiment of a time compression and expansion circuit of audio signals, according to the present invention, will be described in conjunction with FIG. 1.

An input signal, which has been reproduced at a tape travel speed different from that at the time of recording, thereby having a frequency pitch different from that of a recording signal, is introduced through an input terminal 11 and supplied an analog to digital (A/D) converter 12. In the description set hereinafter, it will be assumed that the input reproduced audio signal has been reproduced at a tape speed which is double that in the recording time thereby being compressed half in time base and having a pitch which is twice that of a recording signal.

A clock pulse generated in a clock pulse generator 13 is fed to a counter 14 where it is counted. Simultaneously, the clock pulse is fed to a timing controller 15, which is adapted to form a writing-in pulse and a strobe pulse in synchronism with the clock pulse.

The counter 14 produces as an output a memory writing-in and reading-out switching signal, which is supplied by way of a line 21 to the A/D converter 12 and to a data selector 16. The A/D converter 12 is adapted to convert the input reproduced audio signal from the terminal 11 into a digital signal at a time instance when the switching signal from the counter 14 changes from a memory reading-out level to a memory writing-in level. The data selector 16 allows selectively passing of an address datum for writing-in which undergoes change at a predetermined speed, out of two data fed thereto from the counter 14. The selected datum is applied as an address datum to a random access memory (RAM) 17.

The timing controller 15 is applied with an output from the counter 14, in addition to the above described clock pulse, and produces as an output thereof a memory writing-in pulse on a line 22. In response to the memory writing-in pulse, the RAM 17 operates to write the digital signal from the A/D converter 12 into an address (for example an address #W) designated by the above described address datum.

Next, whereupon the counter 14 counts up by one, the switching signal produced therefrom on the line 21 is changed over from the memory writing-in level to the memory reading-out level. The data selector 16 accordingly selects an address datum for reading out, which is the other one out of the two data fed from the counter 14. The address datum for reading out changes at a speed of one-half of that of the above described address datum for writing in. The data thus selected is applied as an address datum to the RAM 17.

Upon the elapse of the access time determined in the RAM 17, a strobe pulse produced from the timing controller 15 on a line 23 is applied to a latch circuit 18. A latch circuit of this type is illustrated in "Dictionary of Electronics 1974-75" edited by Rudolf Graf, published by Radio Shack Tandy Corp., 1974. As a result, a digital signal having the read-out memory content of an address (for example an address #R) which has been read out from the RAM 17 and designated by said strobe pulse is written in the latch circuit 18. A signal coming from the latch circuit 18 is converted to an analog signal by a digital to analog (D/A) converter 19, and is then led out through an output terminal 20.

At a time instant when the switching signal from the counter 14 comes to change again from the reading-out level to the writing-in level, the input reproduced audio signal is subjected to A/D conversion in the A/D converter 12. The address datum for writing-in coming from the counter 14 passes through data selector 16, and is then applied as a datum of an address #W+1 to the RAM 17, where the digital signal from the A/D converter 12 is written in the address #W+1 designated by this address datum in response to the memory writing-in pulse supplied from the line 22.

Then, simultaneously with counting up by one of the counter 14, the above described switching signal changes to the reading-out level, the above address datum for reading out of two data coming from the counter 14 is selected by a data selector 16. The data thus selected is applied as address datum to the RAM 17. Since this address datum for reading out changes when the counter 14 counts up by two, the datum designates also the address #R which is the same as the preceeding case. After the access time in the RAM 17 elapses, the strobe pulse from the timing controller 15 is applied to the latch circuit 18, where the content from the RAM 17 is written therein. However, since the content thus written-in is the same as that of the preceeding address, no change occurs in the content written in the latch circuit 18, which thus causes no change in analog voltage derived from the output terminal 20.

The same operation is carried out hereinafter, that is, the RAM 17 continues operations such as of writing in an address #W+2, reading out from an address #R+1, writing in an address #W+3, and reading out from the address #R+1.

In this manner, the RAM 17 carries out, in repetition, writing-in operation and reading-out operation alternatively at the same speed, with the reading-out address designation speed being one half of the writing-in address designation speed. Accordingly, the data read out come to have a pitch which is one half of that of the written-in data. As a result, from the output terminal 20 is derived an audio signal in which the pitch thereof is halved, with respect to the input reproduced audio signal introduced through the input terminal 11, to be the same as the pitch of the recording signal, and the time is thereby expanded two times.

Figure 2:
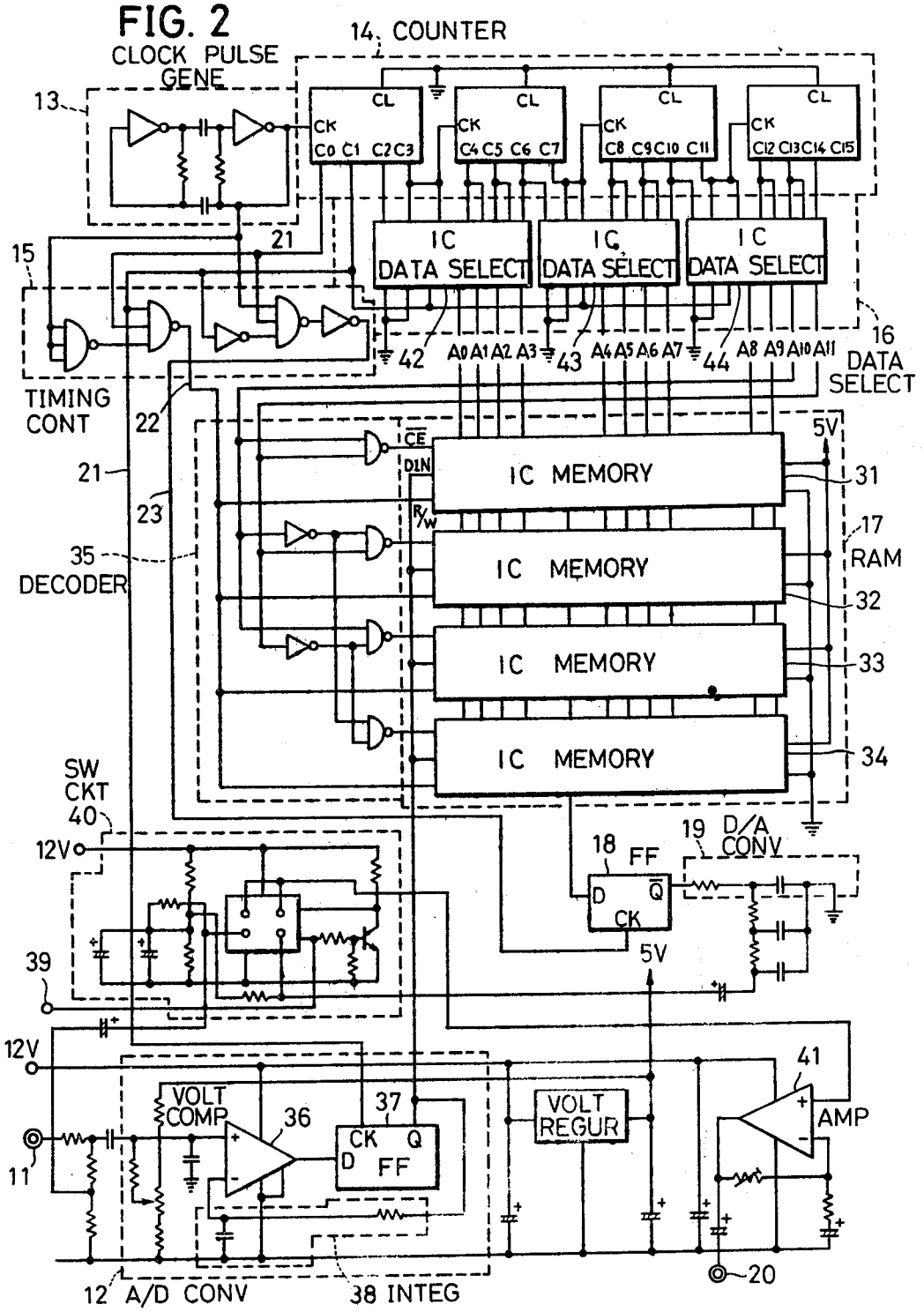
FIG. 2 is a circuit diagram showing one embodiment of a concrete circuit of the block diagram indicated in FIG. 1.

One embodiment of a concrete circuit of the above described block diagram will be described in conjunction with FIG. 2.

The clock pulse generator 13 is constituted by a known astable multivibrator and adapted to produce as clock pulse a square waveform as shown in FIG. 3(A). The counter 14 comprises a 16-bits counter, which produces, from a C1 terminal which is a second bit counted from the bottom place, the above described memory writing-in and reading-out switching signal on the line 21. This switching signal has a waveform as shown in FIG. 3(D), and is adapted to cause the RAM 17 to carry out writing-in operation for the high level period and reading-out operation for the low level period thereof.

The timing controller 15 is supplied with the clock pulse from the generator 13, the output pulse which comes from a first bit terminal CO from the bottom place on the counter 14 and has a waveform as shown in FIG. 3(B), and the switching signal from the terminal C1, and sends out a strobe pulse indicated in FIG. 3(C) and a memory writing-in pulse shown in FIG. 3(E) on the lines 23 and 22 respectively.

Figure 4:
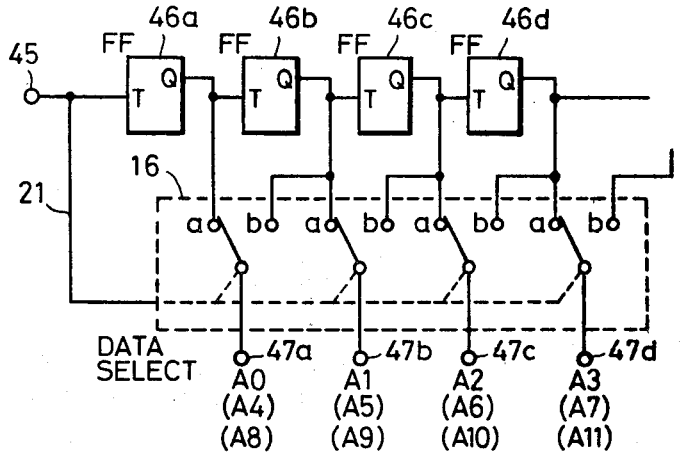
FIG. 4 is a circuit diagram for a description of a part of the circuit indicated in FIG. 2, in principle.

The data selector 16 has a function indicated in principle manner by switches in FIG. 4. In response to the switching signal supplied from the terminal C1 of the counter 14 through a terminal 45 and the line 21, each of switches constituting the data selector 16 is switched over so that its moving contact is connected to its contact point a for a writing-in level (high level) period and to its another contact point b for a reading-out level (low level) period of the switching signal. This switching-over operation of the switch causes the address data from the Q-output terminals of flip-flop circuits 46*a* through 46*d* which constitute a part of the counter 14 and are connected in cascade to be derived selectively from terminals 47*a* through 47*d*.

When each of switches assumes a state wherein its moving contact is connected to its contact point a, the Q-outputs of the flip-flop circuits 46*a* through 46*d* are led out through the terminals 47*a* through 47*d*. In contrast, when each of the switches is in a state wherein its moving contact is connected to its contact point b, the Q-outputs of the flip-flop circuits 46*b* through 46*d* which are shifted by one bit with respect to the above described each of the flip-flop circuits 46*b* through 46*d* and the Q-output of a flip-flop circuit 46*e* (not shown) provided in a succeeding stage to be triggered by the Q-output of the flip-flop circuit 46*d* are led out through the terminals 47*a* through 47*d*. Since the outputs obtained at this time is of outputs in which the outputs at the time when the switch is connected to the contact point a are respectively subjected to ½ frequency division, the reading-out operation is carried out at a speed of one half of the writing-in address designation speed.

The RAM 17 comprises, for example, 1024 bits IC memories 31 through 34, and has ten address buses A0 through A9. This RAM 17, coupled with a two-bits decoder 35, forms a 4096-bits type memory.

The A/D converter 12 comprises a well-known delta modulating circuit consisting of a voltage comparator 36, a D-type flip-flop (latch) circuit 37, and an integration circuit 38. The D/A converter 19 comprises an integration circuit which is adapted to integrate a Z-output of a D-type flip-flop, which constitutes the latch circuit 18.

A digital-converted signal shown in FIG. 3(F) is supplied from the Q-output terminal of the A/D converter 12 to the IC memories 31 through 34 of the RAM 17. A signal shown in FIG. 3(G) is supplied from the RAM 17 to the latch circuit 18. The D/A converter 19 converts the signal from the latch circuit 18 to be an analog signal. The audio signal thus converted to be analog signal is supplied to a switching circuit 40 which performs switching operation responsive to a switching signal introduced through an input terminal 39.

The switching circuit 40 passes therethrough the signal from the D/A converter 19 during the periods when the switching signal from the terminal 39 is in its low level. The signal thus passed through the switching circuit 40 is amplified at an amplifier 41 and is then led out through the output terminal 20. This switching circuit 40 shuts off the signal from the D/A converter 19 during the periods when the switching signal is in its high level, and passes the input reproduced audio signal from the input terminal 11 as it is, which reproduced audio signal is then supplied to the amplifier 41. This switching circuit 40 is used on the occasion of selecting use or non-use of the time compression and expansion circuit.

The embodiment set forth above is described for time expansion, but time compression can be performed similarly as in the preceding case. For example, in a case where the audio signal which has been reproduced at a tape travel speed of one half of that at the recording mode is supplied to the input terminal 11, only the address designation speed at the time of reading-out is increased two times the address designation speed in the writing-in mode. Whereas, the period of the writing-in timing pulse and reading-out timing pulse supplied to the RAM 17 is not changed but maintained as that in the preceding case. For reducing this embodiment into practice, it is sufficient that polarity of signal introduced from the line 21 to the data selector 16 is inverted, contrary to the preceding case. As a result, it becomes possible to obtain a reproduced audio signal wherein pitch is the same as that in a recording signal and the time is compressed in half.

Figure 5:
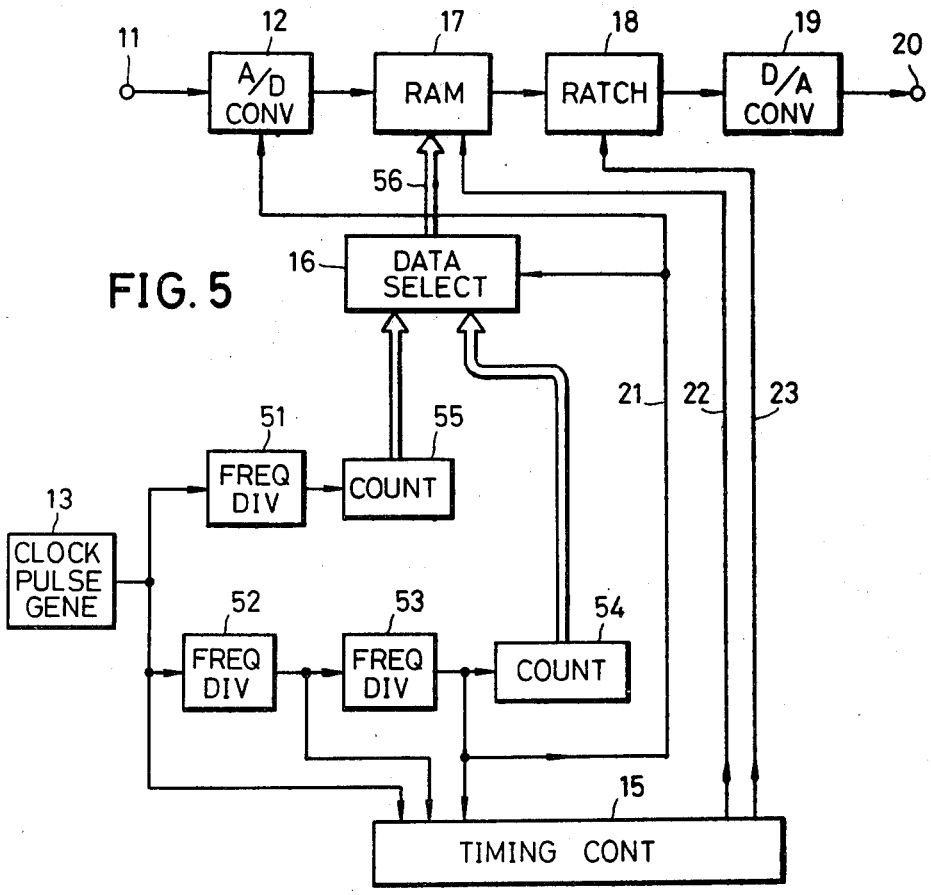
FIG. 5 is a block diagram showing another embodiment of a time compression and expansion circuit of audio signal according to the present invention.

Next, a second embodiment of a circuit of the present invention will be described in conjunction with FIG. 5. In FIG. 5, those parts which are the same as corresponding parts in FIG. 1 are designated by like reference numerals. Detailed description of such parts will be omitted.

The clock pulse generator 13 generates a clock pulse having a waveform as shown in FIG. 6(A). The clock pulse is supplied on hand to the timing controller 15 and on the other hand to frequency dividers 51 and 52. Assuming that the input reproduced audio signal which has been reproduced at a tape travel speed of one and a half times that at the recording time and supplied through the input terminal 11 is subjected to time expansion of one and a half times, the frequency division ratios of the frequency divider 51 and 52 for frequency dividing the clock pulse are set to be 1/6 and $\frac{1}{2}$, respectively. The frequency divider 51 comprises a $\frac{1}{3}$ frequency divider and a $\frac{1}{2}$ frequency divider which are connected in cascade (not shown). A signal which has been $\frac{1}{3}$ frequency divided by the $\frac{1}{3}$ frequency divider is shown in FIG. 6(G).

A signal which has been $\frac{1}{2}$ frequency-divided in the frequency divider 52 and obtained as shown in FIG. 6(B) is supplied to the timing controller 15 and to a $\frac{1}{2}$ frequency divider 53. A signal which has been further subjected to $\frac{1}{2}$ frequency division in the frequency divider 53 and derived as shown in FIG. 6(C) is fed to the timing controller 15, a counter 54, the data selector 16, and the A/D converter 12. The counter 54 comprises a 12-bits counter and forms an address datum for writing-in.

The frequency divider 51 operates 1/6 frequency division of the clock pulse and sends a signal having a waveform as shown in FIG. 6(H) to a counter 55. The counter 55 forms an address datum for reading-out. The reading-out address datum which is formed in the counter 55 and appears in the least significant bit thereof has a waveform as shown in FIG. 6(I), and has a frequency which is $\frac{2}{3}$ times that of the writing-in address datum, in the least significant bit, formed in the counter 54 and having a waveform as shown in FIG. 6(F).

The timing controller 15 is supplied with the above described clock pulse and the frequency divided signals from the frequency dividers 52 and 53, and sends out a reading-out timing pulse shown in FIG. 6(D) and a writing-in timing pulse shown in FIG.6(E) to the RAM 17. The RAM carries out writing-in and reading-out operations alternatively under the control of these timing pulses. It is to be noted that the timing controller 15 may be of a circuit arrangement indicated in FIG. 2.

The input reproduced audio signal from the input terminal 11 is subjected, at the A/D converter 12, to A/D conversion at the time instant when the pulse shown in FIG. 6(C) from the frequency divider 53 steps up. The data selector 16 sends out the writing-in address datum from the counter 54 on an address bus 56 leading to the RAM 17, during a high level period of the pulse applied thereto from the frequency divider 53. The RAM 17 carries out writing-in operation responsive to the writing-in pulse shown in FIG. 6(E), supplied from the timing controller 15 by way of the line 22.

The data selector 16 sends out the output reading-out address datum of the counter 55 on the address bus 56 leading to the RAM 17, when the pulse from the frequency divider 53 becomes its low level.

Thereafter, when the reading-out timing pulse shown in FIG. 6(D) is applied through the line 23 to the latch circuit 18, the content from the RAM 17 is written in the latch circuit 18 responsive to the step-up of the timing pulse. The content thus written in the latch circuit 18 is sent to the D/A converter 19 thereby to be converted to the analog signal. As a result of it, a reproduced audio signal having the same pitch as that of the recording signal and with being expanded to 3/2 in time base is obtained from the output terminal 20.

It is noted that any desired time compression and expansion can be achieved by appropriately selecting division ratio of the frequency division circuit 51, and moreover, by posing a frequency division circuit (not shown) with appropriate division ratio between the output side of the clock pulse generator 13 and the input side of the frequency division circuit 52, in accordance with necessity.

In further detail of the present invention, the clock pulse generator 13 generates the clock pulse (FIG. 3(A)), which is fed to the counter 14 (16-bit binary counter) where it is counted-down by one half in every successive stage.

When the clock pulse (FIG. 3(A)) is applied to the CK terminal of the counter, its frequency is halved to be the pulse (FIG. 3(B)), which is produced as output from the output terminal Co. From the output terminal C1, a pulse with frequency one-fourth of the clock pulse (FIG. 3(D)) is produced. These pulses are used to switch over between writing-in and reading-out addresses for memory.

The pulse, from the terminal C2, with frequency one-eighth of the clock frequency, is used as datum of Least Significant Bit of address datum for writing the memory (address datum is changed every half period of the output pulse from C2; that is, at every fourth clock pulse). The pulse, from the terminal C3, with frequency 1/16 of the clock, is used as datum of Least Significant Bit of address datum for reading out from the memory (address datum for reading-out is changed at every eighth clock pulse).

Therefore, during the time when carrying out reading-out or writing-in operation, address data fed to the memory does not change.

Figure 6:
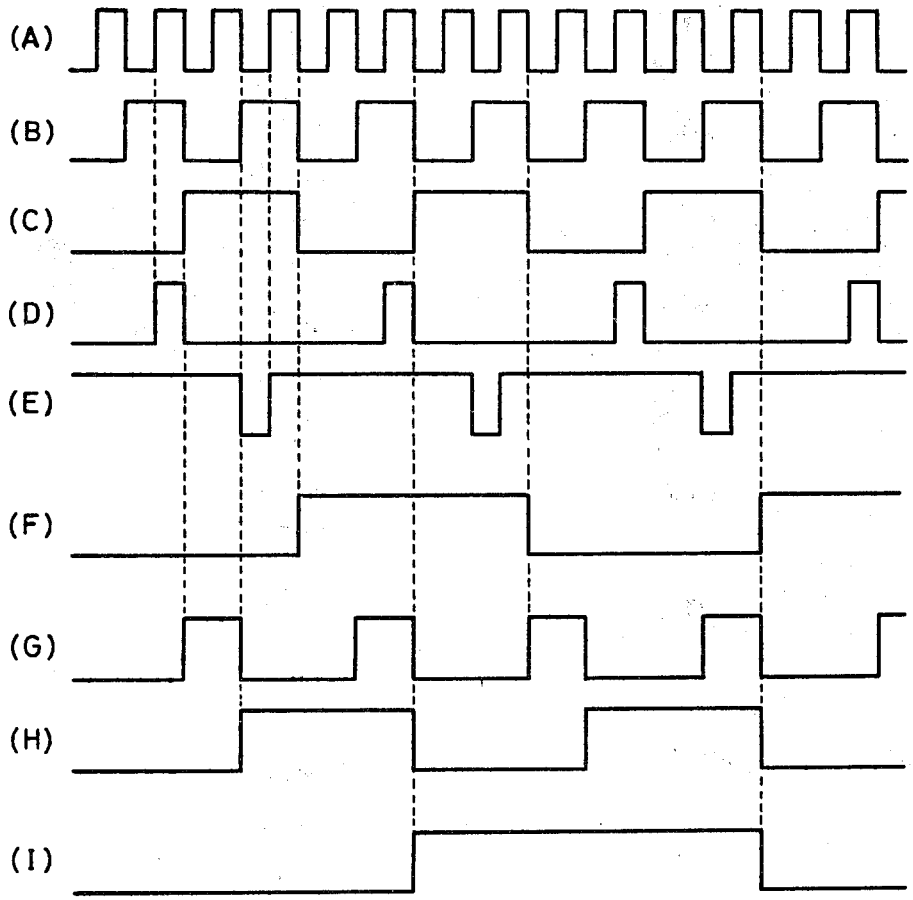
FIG. 6(A) through FIG. 6(I) are waveform time charts respectively showing signals at different points in the block diagram indicated in FIG. 5.

With respect to the embodiment of FIGS. 5 and 6, furthermore, the pulse (FIG. 6(C)) used for data selection has a frequency which is one-fourth of that of the clock pulse.

The output of the counter 54 for producing address data for writing-in has frequencies, the highest value of which corresponds to one-eighth of clock pulse frequency. This output assumes writing-in address data of LSB. The address data for writing-in is changed at one-fourth frequency of clock pulse.

On one hand, the output of the counter 55 for producing address data for reading-out has frequencies, the highest value of which corresponds to 1/12 of clock pulse frequency. This output assumes reading-out address data of LSB. The address data for reading-out is changed at one-sixth frequency of clock pulse.

Here, when a ration of frequency of pulse for changing over between writing-in and reading-out is taken it is apparent that addresses for writing-in and for reading-out are changed over at frequencies of 1/1 and 2/3.

As a result, during the time when carrying out reading-out or writing-in operation, address data fed to the memory does not change.

FIGS. 3(H) and 6(F) show respectively waveforms of LSB (the least significant bit) for coded address datum for writing-in. Every time when level of these signal changes, the address datum undergoes change from #W to #W+1 then to #W+2 so on successively. While, FIGS. 3(I) and 6(I) show respectively waveforms of LSB of coded address datum for reading-out. Every time when level of these signal changes, the address datum undergoes change from #R to #R+1 then to #R+2 so on successively.

These address data #W, #W+1, #W+2 and so on for writing-in does not change during writing-in period (during each writing-in gating interval WT1, WT2, or WT3), as described above. The address data #R, #R+1, and so on for reading-out also does not change during each reading-out gating interval RT1, RT2, RT3, or RT4.

A coded address is possibly kept constant over one period of the timing pulse. For example, in FIGS. 3 and 6, addresses #R for reading-out are kept constant over two period and one-and half period of the timing pulse respectively. In this case, signal data, read out responsive to timing pulses RT1 and RT2, are read out from the same address #R, which means that data having the same contents are read out two time successively.

In the time expansion system, a coded address for writing-in is possibly kept constant over one period of timing pulse.

In the present invention, operations of writing in RAM and of reading out from RAM by way of the latch circuit are carried out alternatively with the same period, but the writing-in address and reading-out address for designating places to be written in and read out are varied at rates different to each other, thus carrying out audio signal time compression and expansion operations.

Figure 3:
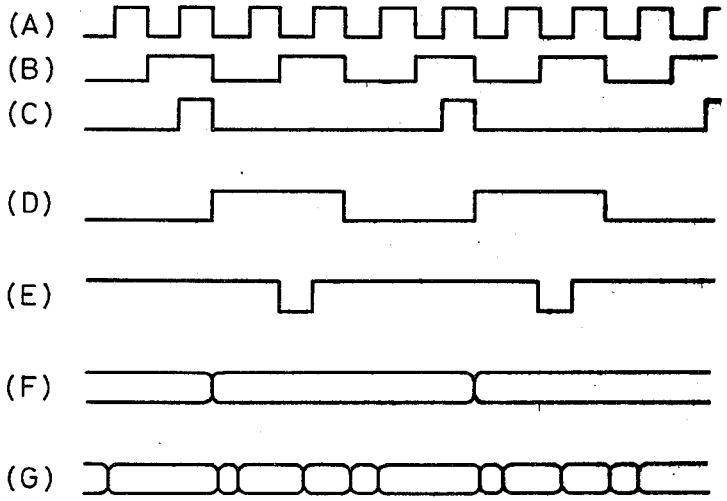
FIG. 3(A) through FIG. 3(G) are waveform time charts respectively showing signals at different points in the circuit indicated in FIG. 2.

Specifically, in the embodiment indicated in FIGS. 1 and 3, every time when writing and reading in and out the memory is switched over, writing-in and reading-out operations are carried out for one time respectively. The address data for writing-in the memory increases by one responsive to every writing-in operation, and the address data for reading-out from the memory increases by one responsive to two reading-out operations.

The result is the same also in the embodiment indicated in FIGS. 5 and 6.

Accordingly, in the embodiment in FIGS. 1 and 3, the writing-in address changes at a frequency which is $\frac{1}{2}$ of writing-in and reading-out changeover frequency, and the reading-out address changes at a frequency which is $\frac{1}{4}$ of said changeover frequency. In the embodiment in FIGS. 5 and 6, the writing-in address changes at a frequency which is $\frac{1}{2}$ of writing-in and reading-out changeover frequency, and the reading-out address changes at a frequency which is $\frac{1}{3}$ of said frequency.

According to the circuit of the present application, furthermore, writing-in and reading-out operations of RAM are repetition of simple operations carried out alternately with the same period. Additionally, all the control signals are formed from a clock pulse from the same (single) generator. Accordingly, all the control circuits can be designed simply by using only the simple logic circuits, not using time delay circuit such as monostable-multivibrator and integrating circuits. Therefore, there are afforded advantageous features such that no adjusting process step is required after assembling, and the control circuit can be used as it is even in the case of changing clock frequency.

Further, this invention is not limited to these embodiments but various variations and modifications may be made without departing from the scope of the invention.

What is claimed is:

1. A time compression or expansion circuit for audio signals comprising:

(a) an analog to digital converter for converting an input audio signal to a digital signal;

(b) a random access memory coupled to said analog to digital converter for writing in and reading out the digital signal supplied from said analog to digital converter;

(c) a latch circuit coupled to the output of said random access memory for holding a signal which has been read out from said random access memory;

(d) a digital to analog converter coupled to said latch circuit for converting the output of said latch circuit to an analog signal and producing and output analog signal which is compressed or expanded in time base with respect to said analog signal;

(e) a clock pulse generator for generating a clock pulse;

(f) a counter circuit for counting the clock pulses from said generator and for producing as outputs thereof an address datum for writing-in of which address changes at a first predetermined rate, an address datum for reading-out of which address changes at a second predetermined rate different from said first predetermined rate, a writing-in and reading-out switching signal, and a timing signal;

(g) a data selector for sending alternatively and selectively the address datum for writing-in and the address datum for reading-out supplied from the counter circuit, to said random access memory, in response to the writing-in and reading-out switching signal supplied from said counter circuit; and (h) a timing controller supplied with the clock pulse from the generator and the timing signal from the counter circuit for producing a series of writing-in pulses and a series of strobe pulses which exist alternatively and have a common frequency regardless of mode of compression or expansion or rate thereof, said analog to digital converter converting the input audio signal to the digital signal in response to the writing-in and reading-out switching pulse from the counter circuit, said random access memory writing the signal from the analog to digital converter, in response to the writing-in pulse fed from the timing controller, into an address thereof designated by the address datum for writing-in, and reading a signal out of an address designated by the address datum for reading-out in response to the strobe pulse of said common frequency, the written address of the memory being read multiple times or skipped being read according to said mode and rate, said latch circuit holding the signal read out from the random access memory in response to the strobe pulse from the timing controller.

2. A time compression or expansion circuit as claimed in claim 1 wherein a ratio of said address changing rates of said address datum for writing-in and the address datum for reading-out derived from the data selector is selected in correspondence with a ratio of the time compression or expansion of the input audio signal which has been expanded or compressed in time base.

3. A time expansion circuit as claimed in claim 1 wherein said input audio signal is a signal which has been compressed in time base by half in comparison with an original signal; and the address changing rate of the address datum for reading-out derived from the data selector is one-half of the address changing rate of the address datum for writing-in.

4. A time compression or expansion circuit as claimed in claim 1 wherein said counter circuit comprises a plurality of flip-flop circuits connected in cascade; and said data selector causes input side signals of the second and subsequent flip-flop circuits and output side signals thereof to pass selectively in response to the writing-in and reading-out switching signal and send them out to the random access memory as the address datum for writing-in and the address datum for reading-out respectively.

5. A time compression or expansion circuit as claimed in claim 1 including a first frequency division circuit for frequency dividing the clock pulse supplied from the generator at a first predetermined frequency division ratio and a second frequency division circuit for frequency dividing the clock pulse supplied from the generator at a second predetermined frequency division ratio which is different from the first predetermined frequency division ratio, and in which said counter circuit comprises a first counter for counting the output signal of the first frequency division circuit and producing the address datum for writing-in, and a second counter for counting the output signal of the second frequency division circuit and producing the address datum for reading-out.

6. A time expansion circuit as claimed in claim 5 in which said input audio signal is a signal having a frequency pitch of one and a half times of a frequency pitch of an original signal; said first frequency division ratio of the first frequency division circuit is 1/6; said second frequency division ratio of the second frequency division circuit is ¼; and said output signal of the digital to analog converter has been expanded by one and a half times in time base in comparison with the input audio signal.

7. A time compression or expansion circuit as defined in claim 1 wherein a ratio of said address changing rates of said address datum for writing-in and the address datum for reading-out derived from the data selector is selected in correspondence with a ratio of the time compression or expansion of the input audio signal which has been expanded or compressed in time base, said input audio signal being a signal which has been compressed in time base by half in comparison with an original signal; and the address changing rate of the address datum for reading-out derived from the data selector is one-half of the address changing rate of the address datum for writing-in, said counter circuit comprising a plurality of flip-flop circuits connected in cascade; and said data selector causes input side signals of the second and subsequent flip-flop circuits and output side signals thereof to pass selectively in response to the writing-in and reading-out switching signal and send them out to the random access memory as the address datum for writing-in and the address datum for reading-out respectively, a first frequency division circuit for frequency dividing the clock pulse supplied from the generator at a first predetermined frequency division ratio and a second frequency division circuit for frequency dividing the clock pulse supplied from the generator at a second predetermined frequency division ratio which is different from the first predetermined frequency division ratio, and in which said counter circuit comprises a first counter for counting the output signal of the first frequency division circuit and producing the address datum for writing-in, and a second counter for counting the output signal of the second frequency division circuit and producing the address datum for reading-out, said input audio signal being a signal having a frequency pitch of two-thirds of a frequency pitch of an original signal; said first frequency division ratio of the first frequency division circuit is 1/6; said second frequency division ratio of the second frequency division circuit is ¼; and said output signal of the digital to analog converter has been compressed by two-thirds in time base in comparison with the input audio signal.

* * * * *